US011098858B2

(12) United States Patent
Westling et al.

(10) Patent No.: US 11,098,858 B2
(45) Date of Patent: Aug. 24, 2021

(54) PORTABLE LIGHT HAVING A PIVOTABLE LIGHT HEAD

(71) Applicant: MILWAUKEE ELECTRIC TOOL CORPORATION, Brookfield, WI (US)

(72) Inventors: Bennett W. Westling, Milwaukee, WI (US); Benjamin D. Gall, Milwaukee, WI (US); Joshua Schermerhorn, Wauwatosa, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 16/395,565

(22) Filed: Apr. 26, 2019

(65) Prior Publication Data

US 2019/0331306 A1 Oct. 31, 2019

Related U.S. Application Data

(60) Provisional application No. 62/662,842, filed on Apr. 26, 2018.

(51) Int. Cl.
*F21L 4/04* (2006.01)
*F21V 23/04* (2006.01)
(Continued)

(52) U.S. Cl.
CPC ..... *F21L 4/045* (2013.01); *F21L 4/027* (2013.01); *F21V 5/006* (2013.01); *F21V 5/04* (2013.01);
(Continued)

(58) Field of Classification Search
CPC ..... F21L 4/045; F21L 4/027; F21V 29/763; F21V 29/89; F21V 5/006; F21V 5/04; F21V 21/0885; F21V 21/0965; F21V 23/0428
(Continued)

(56) References Cited

U.S. PATENT DOCUMENTS 1,651,307 A 11/1927 Wilkinson
3,885,148 A 5/1975 Di Benedetto
(Continued)

FOREIGN PATENT DOCUMENTS

CN 2103086 U 4/1992
CN 201836655 U 5/2011
(Continued)

OTHER PUBLICATIONS

Schumacher, "SL25 LED Cordless Extendable Work Light-12 pack display", <www.batterychargers.com/en/products/work-light-road-flares/sl25-led-cordless-extendable-work-light-12-pack-display> web page accessed on Sep. 28, 2018.
(Continued)

*Primary Examiner* — Bryon T Gyllstrom
(74) *Attorney, Agent, or Firm* — Michael Best & Friedrich LLP

(57) ABSTRACT

A portable light includes a body having a first end and a second end. The body defines a longitudinal axis extending through the first end and the second end, and is configured to receive a battery. The portable light also includes a light head pivotably coupled to the first end of the body, a first light source supported by the light head, and a second light source supported by the light head. The first light source includes a spot light emitting diode configured to emit light in a direction substantially parallel to the longitudinal axis, and the second light source includes a flood light emitting diode configured to emit light in the direction substantially parallel to the longitudinal axis. The portable light further includes an actuator supported by the body and operable to selectively turn on the first light source and the second light source.

19 Claims, 6 Drawing Sheets

(51) Int. Cl.

| | |
|---|---|
| ***F21L 4/02*** | (2006.01) |
| ***F21V 29/76*** | (2015.01) |
| ***F21V 5/00*** | (2018.01) |
| ***F21V 21/088*** | (2006.01) |
| ***F21V 21/096*** | (2006.01) |
| ***F21V 29/89*** | (2015.01) |
| ***F21V 5/04*** | (2006.01) |
| ***F21Y 115/10*** | (2016.01) |

(52) U.S. Cl.
CPC ..... *F21V 21/0885* (2013.01); *F21V 21/0965* (2013.01); *F21V 23/0428* (2013.01); *F21V 29/763* (2015.01); *F21V 29/89* (2015.01); *F21Y 2115/10* (2016.08)

(58) Field of Classification Search
USPC ..... 362/199
See application file for complete search history.

(56) References Cited

U.S. PATENT DOCUMENTS 5,077,644 A * 12/1991 Schaller ..... F21L 4/022 362/184
5,097,399 A * 3/1992 Gammache ..... F21L 4/04 362/197
5,517,392 A 5/1996 Rousso et al.
5,521,803 A 5/1996 Eckert et al.
D371,855 S 7/1996 Heun
D373,211 S 8/1996 Heun
5,558,430 A * 9/1996 Booty, Jr. ..... F21L 4/02 362/184
5,567,115 A 10/1996 Carbone
D375,811 S 11/1996 Hon
5,707,137 A 1/1998 Hon
5,765,938 A 6/1998 Rousso et al.
5,823,657 A 10/1998 Price et al.
5,871,272 A * 2/1999 Sharrah ..... F21L 4/025 362/184
5,906,426 A 5/1999 Farrington et al.
6,040,660 A 3/2000 Schmidt et al.
6,280,050 B1 8/2001 Bird et al.
6,454,789 B1 9/2002 Chen et al.
6,457,841 B1 10/2002 Lynch et al.
6,543,911 B1 4/2003 Rizkin et al.
6,581,889 B2 6/2003 Carpenter et al.
6,666,563 B2 12/2003 Brown
6,702,837 B2 3/2004 Gutwein
6,718,136 B2 4/2004 Bird et al.
6,799,861 B2 10/2004 Naghi et al.
6,808,289 B2 10/2004 Reed
6,814,470 B2 11/2004 Rizkin
6,854,861 B2 2/2005 Chao
6,874,908 B2 4/2005 Sharrah et al.
6,899,443 B2 5/2005 Rizkin et al.
6,902,291 B2 6/2005 Rizkin et al.
D510,637 S 10/2005 Chan
6,951,418 B2 10/2005 Rizkin et al.
6,953,260 B1 10/2005 Allen
6,986,782 B2 1/2006 Chen et al.
6,988,815 B1 1/2006 Rizkin et al.
7,021,797 B2 4/2006 Minano
7,140,754 B2 11/2006 Thuma et al.
7,168,824 B2 1/2007 Schnell
7,186,002 B2 3/2007 Matthews et al.
7,281,815 B1 10/2007 Gustafson et al.
7,281,820 B2 10/2007 Bayat et al.
7,286,296 B2 10/2007 Chaves et al.
D560,834 S 1/2008 Nagano
7,329,029 B2 2/2008 Chaves et al.
7,344,270 B2 3/2008 Kim
7,380,962 B2 6/2008 Chaves et al.
7,402,961 B2 7/2008 Bayat et al.
7,416,311 B2 8/2008 Dietz
7,503,669 B2 3/2009 Rizkin et al.
7,549,766 B2 6/2009 Sharrah et al.
7,553,051 B2 6/2009 Brass et al.
7,652,216 B2 1/2010 Sharrah et al.
D612,524 S 3/2010 Booher
D612,967 S 3/2010 Gan et al.
7,674,003 B2 3/2010 Sharrah et al.
7,724,440 B2 5/2010 Chaves et al.
7,731,385 B2 * 6/2010 Spartano ..... H05B 35/00 362/184
7,744,246 B2 6/2010 Rizkin et al.
7,755,838 B2 6/2010 Chaves et al.
7,753,561 B2 7/2010 Chaves et al.
7,888,883 B2 2/2011 Crawford et al.
7,950,821 B1 * 5/2011 Georgitsis ..... B60Q 1/0483 362/217.12
8,016,451 B2 9/2011 Householder et al.
8,033,681 B2 10/2011 Brass et al.
8,061,880 B2 11/2011 Lambert et al.
8,075,147 B2 12/2011 Chaves et al.
8,147,089 B2 4/2012 Matthews et al.
8,182,109 B2 5/2012 Matthews et al.
8,220,959 B2 7/2012 Rizkin et al.
8,360,615 B2 1/2013 Rizkin et al.
8,403,515 B2 3/2013 Eichelberger et al.
8,419,214 B2 4/2013 Rizkin et al.
RE44,281 E 6/2013 Snyder
8,529,086 B2 9/2013 Skrivan et al.
8,562,184 B2 10/2013 Klipstein et al.
8,632,223 B2 1/2014 McDermott
D707,869 S 6/2014 Wu
8,789,963 B2 7/2014 Whitfield et al.
D719,286 S 12/2014 Inskeep
8,944,626 B2 2/2015 Matthews et al.
8,981,650 B2 3/2015 Burayez et al.
9,018,848 B2 4/2015 Garcia
9,060,407 B2 6/2015 West
9,144,138 B2 9/2015 Kie
D740,986 S 10/2015 Hine et al.
D743,598 S 11/2015 Inskeep
9,182,089 B2 11/2015 Whitfield et al.
9,188,292 B2 11/2015 Armer et al.
9,297,509 B2 3/2016 Klipstein et al.
D765,295 S 8/2016 McLennan
D767,187 S 9/2016 Hine
D767,805 S 9/2016 Son et al.
9,464,767 B2 10/2016 Whitfield et al.
D790,097 S 6/2017 Port
D802,192 S 11/2017 Windom et al.
9,863,622 B1 1/2018 Armer et al.
D812,178 S 3/2018 Galli
D818,621 S 5/2018 Kunzendorf
D823,509 S 7/2018 Kunzendort
D837,428 S 1/2019 Arena
D843,624 S 3/2019 Son et al.
D851,310 S 6/2019 Windom et al.
D855,851 S 8/2019 Kotsis et al.
D857,268 S 8/2019 Worman
2002/0109986 A1 8/2002 Siegel
2003/0161143 A1 8/2003 Parker et al.
2004/0090776 A1 5/2004 Yang
2004/0145890 A1 * 7/2004 Liao ..... F21L 4/08 362/183
2004/0174703 A1 9/2004 Tally
2005/0207170 A1 9/2005 Opolka
2006/0083010 A1 4/2006 Ping
2006/0193129 A1 8/2006 Opolka
2006/0278816 A1 12/2006 Booty
2007/0030672 A1 2/2007 Offiler
2007/0253195 A1 11/2007 Dietz
2009/0116230 A1 5/2009 Young
2010/0046211 A1 * 2/2010 Spartano ..... F21L 4/027 362/157
2010/0053942 A1 3/2010 Tarter et al.
2010/0103656 A1 4/2010 Cho
2011/0157874 A1 * 6/2011 Sant ..... F21L 14/00 362/106
2011/0242799 A1 10/2011 Dyer
2012/0140457 A1 6/2012 McQuade
2012/0176802 A1 7/2012 Householder et al.

(56) References Cited

U.S. PATENT DOCUMENTS

| | | | | |
|---|---|---|---|---|
| 2014/0268682 | A1 | 9/2014 | Brady | |
| 2016/0348880 | A1 | 12/2016 | Galli et al. | |
| 2017/0191646 | A1 | 7/2017 | Marie et al. | |
| 2017/0215983 | A1 | 8/2017 | Learn | |
| 2017/0284646 | A1* | 10/2017 | Arena | F21V 23/06 |
| 2017/0292659 | A1* | 10/2017 | Bayat | F21L 4/045 |

FOREIGN PATENT DOCUMENTS

| | | | |
|---|---|---|---|
| CN | 201844212 | U | 5/2011 |
| CN | 206247092 | U | 6/2017 |
| CN | 206310294 | U | 7/2017 |
| DE | 102012109648 | A1 | 4/2014 |
| EP | 1930649 | A1 | 6/2008 |
| WO | 0177575 | A1 | 10/2001 |
| WO | 2006080918 | A1 | 8/2006 |
| WO | 11036691 | A1 | 3/2011 |

OTHER PUBLICATIONS

Milwaukee Tool, "Service Parts List Cordless 12 Volt LED Worklight", Catalog No. 49-24-0146, Oct. 2017 (2 pages).

Milwaukee Tool, "Operators Manual—Worklights", Catalog No. 49-24-0145, Feb. 2015 (12 pages).

Milwaukee Tool, "Service Parts List Cordless 18 Volt LED Worklight", Catalog No. 2735-20, Mar. 2012 (1 page).

* cited by examiner

PORTABLE LIGHT HAVING A PIVOTABLE LIGHT HEAD

CROSS-REFERENCE TO RELATED APPLICATIONS

This application claims priority to U.S. Provisional Patent Application No. 62/662,842, filed on Apr. 26, 2018, the entire contents of which are incorporated by reference herein.

FIELD OF THE INVENTION

The present invention relates to portable lights and, more particularly, to lights with pivotable light heads.

SUMMARY

In one embodiment, the invention provides a portable light including a body having a first end and a second end. The body defines a longitudinal axis extending through the first end and the second end. The body is configured to receive a battery. The portable light also includes a light head pivotably coupled to the first end of the body, and a first light source supported by the light head. The first light source includes a spot light emitting diode configured to emit light in a direction substantially parallel to the longitudinal axis. The portable light further includes a second light source supported by the light head. The second light source includes a flood light emitting diode configured to emit light in the direction substantially parallel to the longitudinal axis. The portable light also includes an actuator supported by the body. The actuator is operable to selectively turn on the first light source and the second light source.

In another embodiment, the invention provides a portable light including a body having a first end and a second end. The body defines a longitudinal axis extending through the first end and the second end. The body is configured to receive a battery. The portable light also includes a light head pivotably coupled to the first end of the body. The light head has a heat sink formed of a metallic material. The heat sink defines an outer surface of the light head. The portable light further includes one or more light emitting diodes coupled to the light head, and a lens coupled to the light head and operable to diffuse light emitted from the one or more light emitting diodes.

In yet another embodiment, the invention provides a portable light including a body having a first end and a second end. The body defines a longitudinal axis extending through the first end and the second end. The body is configured to receive a battery. The portable light also includes a light head pivotably coupled to the first end of the body, a first light source including a first light emitting diode, a second light source including a second light emitting diode, and a lens coupled to the light head. The lens includes a first section aligned with the first light source and a second section aligned with the second light source. The second section has a different configuration than the first section. The first section and the second section are integrally formed.

Other aspects of the invention will become apparent by consideration of the detailed description and accompanying drawings.

DETAILED DESCRIPTION

Figure 1:
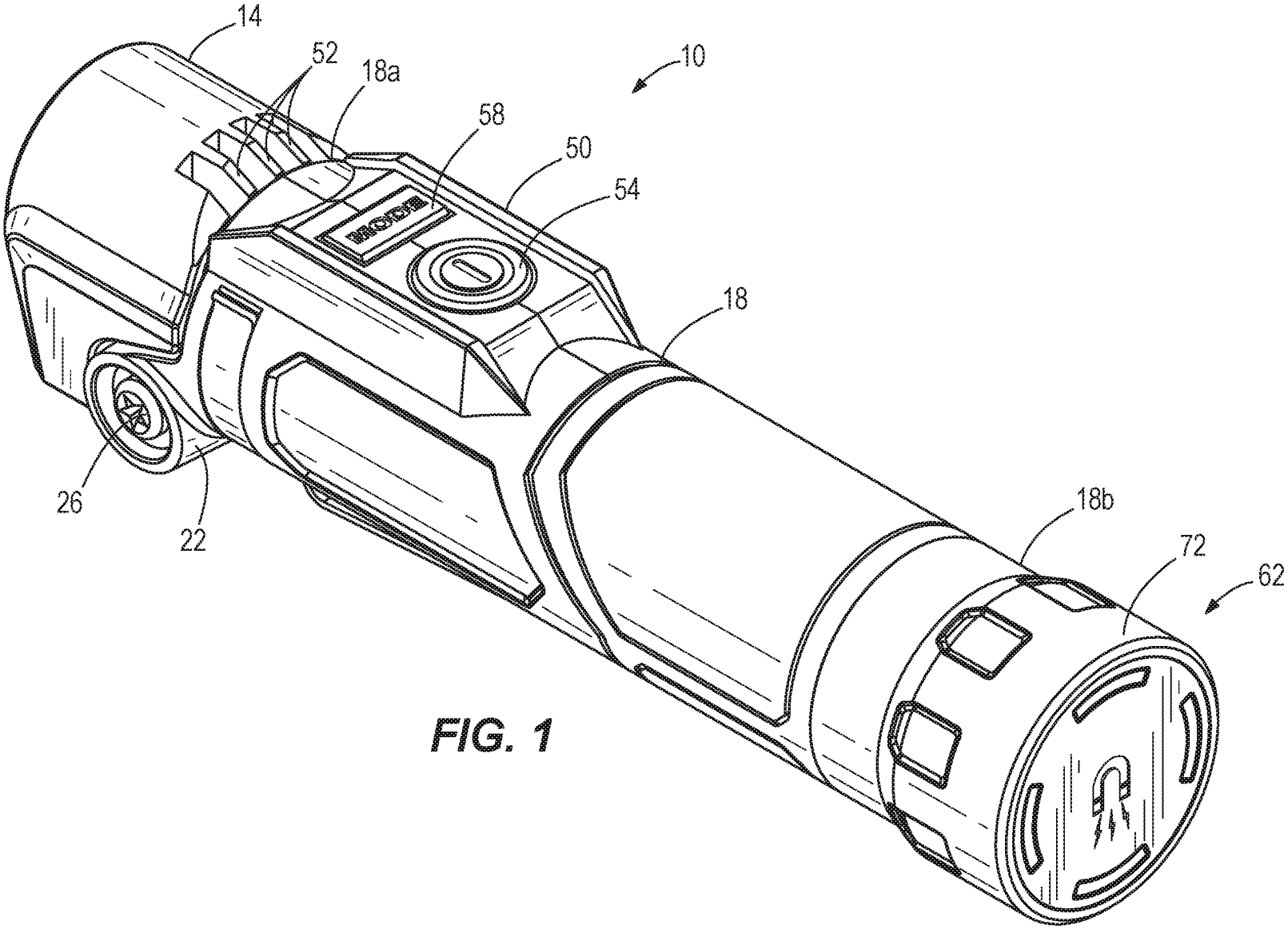
FIG. 1 is a perspective view of a portable light.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

FIGS. 1-5 illustrate a portable light 10 according to one embodiment of the invention. The illustrated light 10 includes a light head 14 and a body 18. The body 18 is configured to be grasped and held by a user. The light head 14 is moveable (e.g., pivotable) relative to the body 18 to change the direction in which light is emitted from the portable light 10.

The illustrated body 18 is generally cylindrical and includes a first end 18*a* and a second end 18*b*. The body 18 also defines a central longitudinal axis 20 (FIG. 5) extending through the first and second ends 18*a*, 18*b*. The body 18 further includes a boss 22 formed at the first end 18*a* of the body 18. The boss 22 is offset from the central longitudinal axis 20 and coupled to the light head 14. In the illustrated embodiment, the boss 22 includes a fastener 26 (e.g., a screw) to secure the light head 14 to the body 18. The fastener 26 defines a pivot axis 28 (FIG. 4) about which the light head 14 can pivot relative to the body 18. The illustrated pivot axis 28 is perpendicular to the central longitudinal axis 20 of the body 18. As further described below, the light head 14 is pivotable relative to the body 18 between a first or inline position (FIG. 3A), a second or partially-extended position (FIG. 3B), and a third or fully extended position (FIG. 3C). In some embodiments, the fastener 26 can be further tightened to temporarily retain the light head 14 in different positions relative to the body 18.

Figure 2:
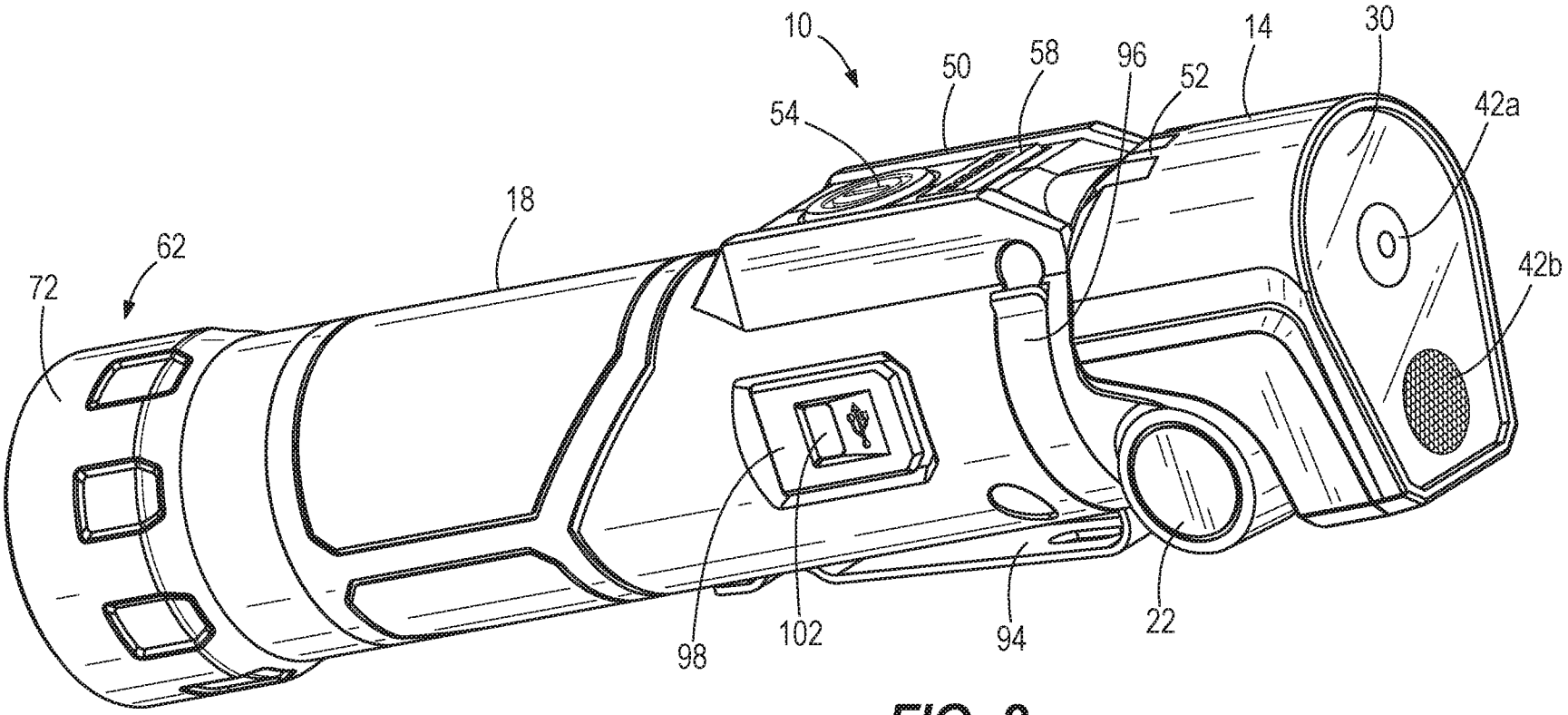
FIG. 2 is another perspective view of the portable light of FIG. 1.
Figure 4:
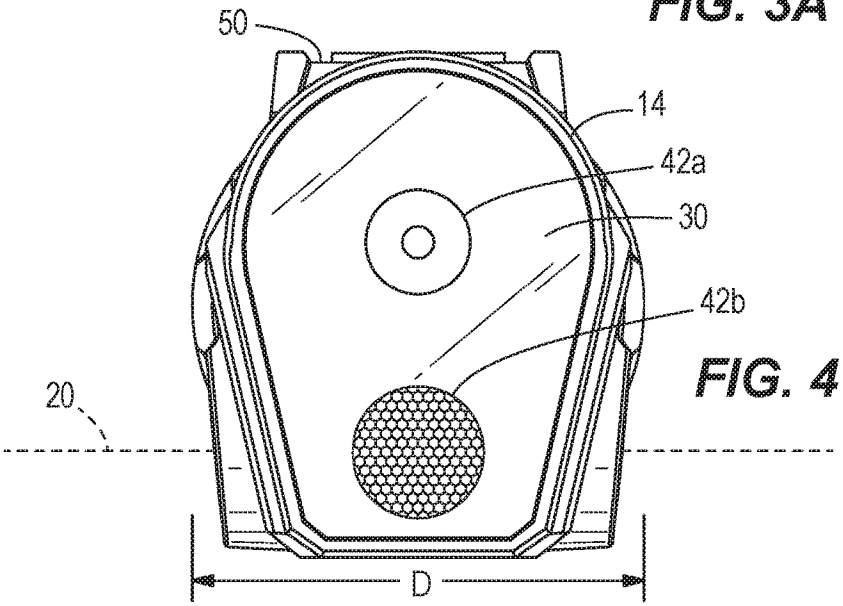
FIG. 4 is a front view of the portable light of FIG. 1.

The light head 14 includes a lens 30, a plurality of light sources 34, 38 (FIG. 5), and a heat sink 46. The lens 30 covers the light sources 34, 38 to protect the light sources 34, 38 and diffuse light emitted from the light sources 34, 38 to the surrounding area. As shown in FIGS. 2 and 4, the illustrated lens 30 includes a first lens section 42*a* aligned with the first light source 34, and a second lens section 42*b* aligned with the second light source 38. The first lens section 42*a* is contoured to diffuse light from the first light source 34. The second lens section 42*b* includes a plurality of total internal reflection (TIR) lenses. In the illustrated embodiment, the first and second lens sections 42*a*, 42*b* are integrally formed as a single lens. In other embodiments, the first and second lens sections 42*a*, 42*b* may be formed as separate lenses.

Figure 5:
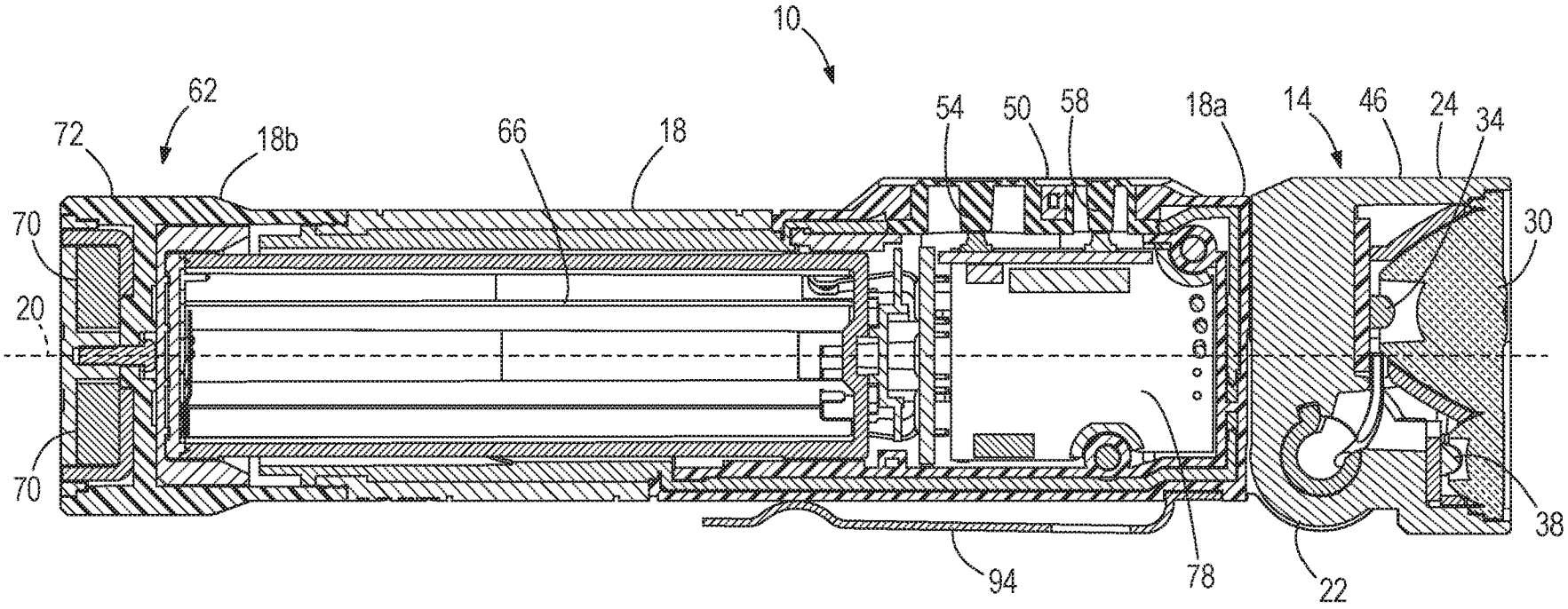
FIG. 5 is a cross-sectional view of the portable light of FIG. 1

As shown in FIG. 5, the light sources 34, 38 are positioned behind the lens 30. The first light source 34 is different than the second light source 38. In the illustrated embodiment, the light sources 34, 38 include light emitting diodes (LEDs). In particular, the first light source 34 includes a single spot LED, while the second light source 38 includes at least one flood LED. In other embodiments, the first light source 34 and/or the second light source 38 may include one or more LEDs. In further embodiments, the light head 14 may include other suitable light sources.

As shown in FIG. 5, the heat sink 46 forms an outer housing of the light head 14. The heat sink 46 thereby supports the other components of the light head 14, such as the light sources 34, 38 and the lens 30. As such, the entire light head 14 may be considered the heat sink 46 that diffuses any excessive or unwanted heat from the light sources 34, 38. In the illustrated embodiment the heat sink 46 is formed as a single, monolithic part. The heat sink 46 also defines an outer surface 24 of the light head 14. However, in alternative embodiments, the heat sink 46 may define alternative portions or surfaces of the light head 14. The heat sink 46 is formed of a metallic material (e.g., aluminum, etc.). However, in alternative embodiments, the heat sink 46 may be composed of alternative materials. In the illustrated embodiment, a plurality of fins 52 (FIG. 1) is formed in the other surface 24 of the heat sink 46. The illustrated fins 52 are located adjacent the first end 18*a* of the body and increase the surface area of the heat sink 46 to dissipate heat away from the light head 14.

Referring back to FIG. 1, the light sources 34, 38 are controlled via a control panel 50. The illustrated control panel 50 is positioned adjacent the first end 18*a* of the body 18. The control panel 50 includes one or more actuators electrically connected to the light sources 34, 38 to control operation of the light 10. In the illustrated embodiment, the control panel 50 includes a power actuator 54 to turn the light sources 34, 38 on and off. The illustrated control panel 50 also includes a mode actuator 58 to change an operating mode of the light 10. For example, the mode actuator 58 can cycle through a spot mode in which only the first light source 34 is turned on, and a flood mode in which only the second light source 38 is turned on. More specifically, the mode actuator 58 is additionally capable of cycling through a high flood mode in which the second light source 38 is capable of emitting light at a high intensity, and a low flood mode in which the second light source 38 is capable of emitting light at a low intensity. In alternative embodiments, the light 10 may be operable in an additional mode in which both light sources 34, 38 are turned on. In still further embodiments, the mode actuator 58 may change the first light source 34 (e.g., the spot LED) between operating in a high mode and a low mode. In the illustrated embodiment, the actuators 54, 48 are buttons, but may alternatively be switches, dials or other suitable control mechanisms.

When operating in the spot mode, the light 10 may have a maximum output of at least 500 lumens. When operating in the high flood mode, the light 10 may have a maximum output of at least 400 lumens. When operating in the low flood mode, the light 10 may have a maximum output of at least 100 lumens.

With continued reference to FIG. 1, the body 18 includes a battery housing 62 formed between the first end 18*a* and the second end 18*b*. The battery housing 62 is configured to house a power source 66 (FIG. 5), such as a battery. In the illustrated embodiment, the power source 66 is insertable into and removable from the battery housing 62 along an insertion axis that is coaxial with the central longitudinal axis 20 of the body 18. In some embodiments, the power source 66 may have a Li-ion chemistry such that the power source 66 is also relatively lightweight (e.g., about 2 ounces or 55 grams). In other embodiments, the battery 66 may have other chemistries, such as an alkaline chemistry.

The power source 66 is insertable into and removable from the battery housing 62 via a battery cap 72. The battery cap 72 is removably coupled to the second end 18*b* of the body 18. When connected to the body 18, the battery cap 72 inhibits dirt and other debris from entering the battery housing 62. The battery cap 72 also helps retain the power source 66 within the battery housing 62, but is also removable from the body 18 to facilitate recharging or replacement of the power source 66. The illustrated battery cap 72 includes one or more magnets 70 (FIG. 5) such that the light 10 can be supported and retained on a metal surface.

The power source 66 is sufficient to operate the light sources 34, 38 for extended periods of time. For example, the power source 66 can operate the first light source 34 (e.g., the spot LED) in the high mode for at least 2.5 hours. In addition, the power source 66 can operate the second light source 38 (e.g., the flood LED) in the high flood mode for at least 3 hours. Furthermore, the power source 66 can operate the second light source 38 in the low flood mode for at least 10 hours.

During use, the power source 66 may become depleted. As the power source 66 loses energy, both the first light source 34 (when operating in the high mode) and the second light source 38 may decrease in intensity to conserve power. For example, the light sources 34, 38 may gradually decrease intensity to less than 300 lumens over time. In some embodiments, the light sources 34, 38 may decrease to 292 lumens and maintain this intensity until the power source 66 is completely depleted.

As shown in FIG. 5, the light 10 also includes an internal control unit 78, such as a microcontroller or memory unit, for storing information and executable functions associated with the light 10. The internal control unit 78 is positioned within the body 18 and electrically coupled to the power source 66, the control panel 50, and the light sources 34, 38. The internal control unit 78 is configured to store the state of the light 10 as set by the mode actuator 58 when the light 10 is powered ON and OFF by the power actuator 54. This results in a light 10 that may be turned ON and OFF while maintaining the most recent state of the light 10 (e.g., the mode of the light 10, the light sources 34, 38 in use, etc.), thereby allowing the user to turn the light 10 on with the last setting without having to readjust the mode of the light 10. In some embodiments, the light sources 34, 38 may cycle on and off and through the modes (e.g., spot/high, spot/low, flood) by repeatedly pressing the mode actuator 58.

As shown in FIGS. 2 and 3A-3C, the light 10 also includes a clip 94 coupled to the body 18. The illustrated clip 94 extends substantially parallel to the central longitudinal axis 20 of the body 18. The clip 94 allows the light 10 to be hung or clipped to another object (e.g., a belt loop, etc.) and allows the light 10 to be portable. In the illustrated embodiment, the clip 94 is removable from the body 18 by a C-shaped clamp 96. In other embodiments, the clip 94 may be permanently coupled to the body 18.

The light 10 further includes a charging port 98 supported on the body 18. The charging port 98 is electrically coupled to the power source 66 in the battery housing 62. The charging port 98 allows the power source 66 to be recharged while in the battery housing 62. In the illustrated embodiment, the charging port 98 is positioned on a side of the body 18 adjacent the control panel 50. In other embodiments, the charging port 98 may be positioned elsewhere on the body 18 or on the battery cap 62. The illustrated charging port 98 includes a USB port, although other suitable charging ports may also or alternatively be included on the light 10.

During use, the light head 14 is movable relative to the body 18 to change the orientation at which light is emitted from the light sources 34, 38. More particularly, the light head 14 is pivotable relative to the body 18 about the pivot axis 28 (FIG. 4). In the illustrated embodiment, the light head 14 is pivotable up to 110 degrees, allowing a user to redirect the lens 30 and the light sources 34, 38 from approximately 0 degrees (e.g., FIG. 3A) to approximately 110 degrees (e.g., FIG. 3C). For example, the light head 14 is pivotable between the inline position (e.g., FIG. 3A) and multiple angled positions (e.g., FIGS. 3B-3C). When in the inline position, the light sources 34, 38 emit light from the light head 14 in a direction generally parallel to the central longitudinal axis 20 of the body 18. When in any of the angled positions, the light sources 34, 38 emit light from the light head 14 in directions that are angled (i.e., not parallel to) the central longitudinal axis 20 of the body 18. When the light head 14 is fully pivoted relative to the body, the lens 30 and the light sources 30, 34 are angled approximately 110 degrees relative to the central longitudinal axis 20.

Figure 3A:
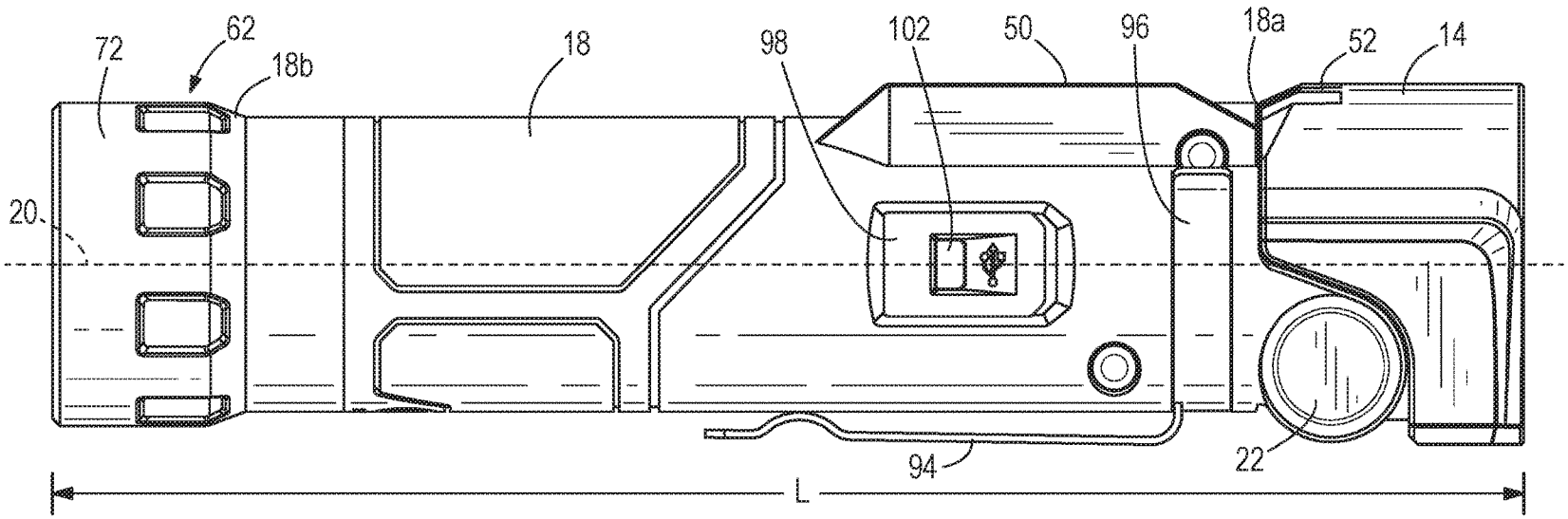
FIG. 3A is a side view of the portable light of FIG. 1 in an in-line position.
Figure 3B:
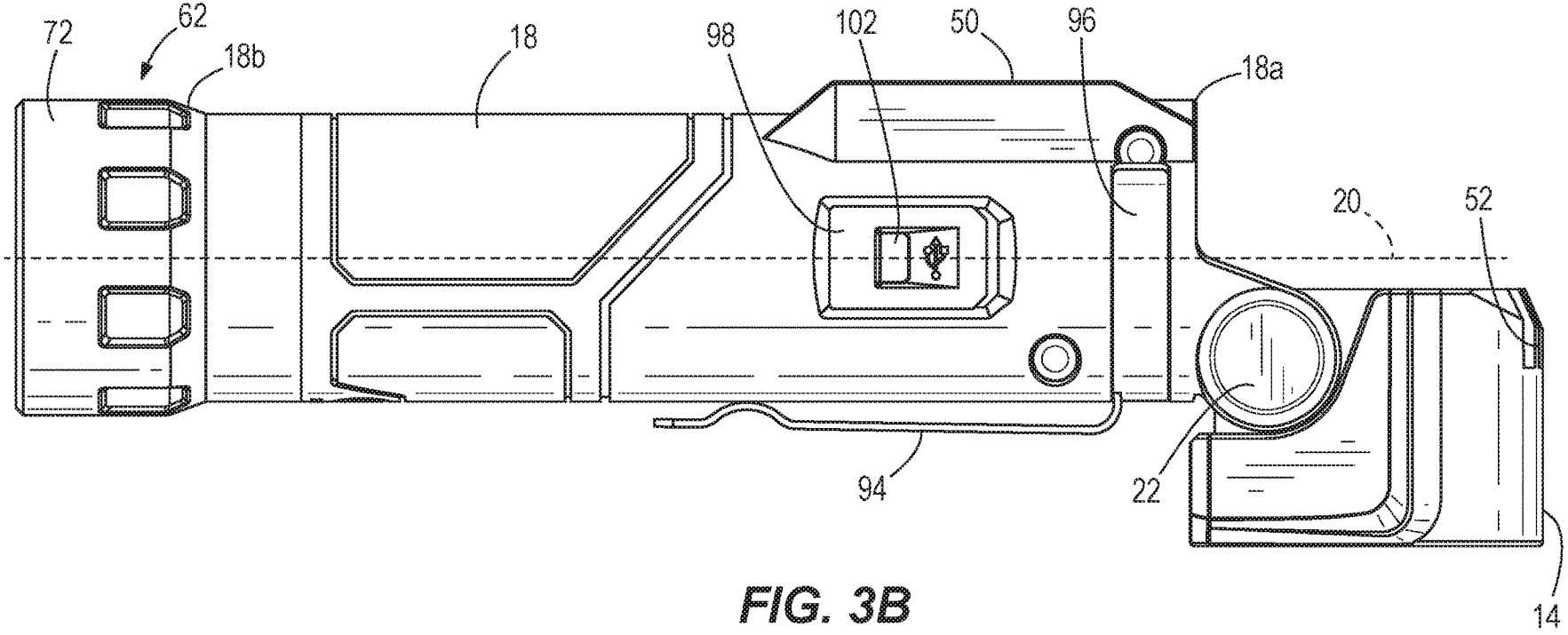
FIG. 3B is a side view of the portable light of FIG. 1 in a partially extended position.
Figure 3C:
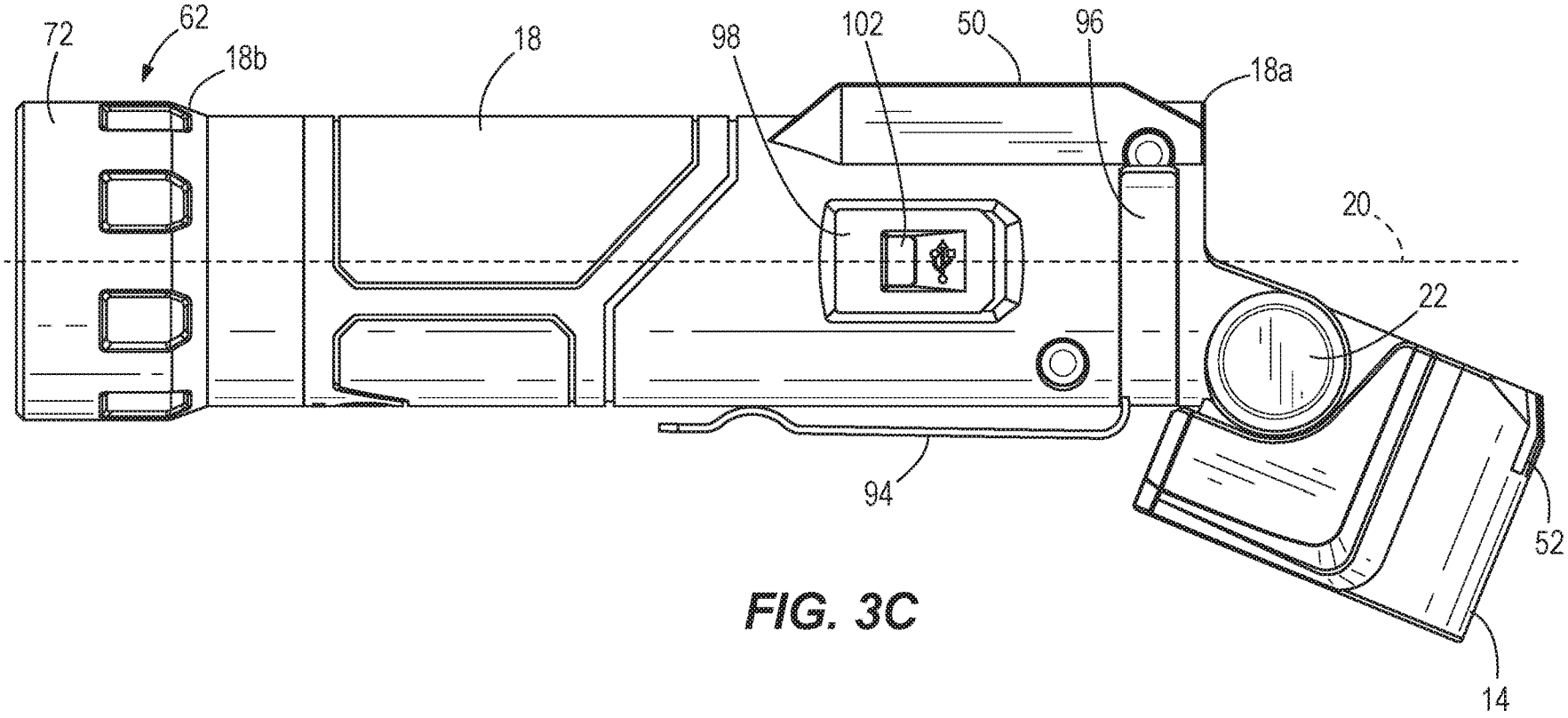
FIG. 3C is a side view of the portable light of FIG. 1 in a full extended position.

As shown in FIG. 3A, when in the inline position, the light 10 has an overall length L (measured between the lens 30 of the light head 30 and the battery cap 62 in a direction parallel to the central longitudinal axis 20) between 6 and 7 inches. More particularly, the overall length L is about 6.13 inches. As shown in FIG. 4, the light 10 has an overall diameter D (measured across the lens 30 in a direction normal to the central longitudinal axis) between 1 and 2 inches. More particularly, the overall diameter D is about 1.34 inches. With the power source 66 included, the light 10 has an overall weight of between 6 and 7 ounces. More particularly, the overall weight is about 6.67 ounces (190 grams). Without the power source 66, the light 10 has a weight of between 4 and 5 ounces. More particularly, the weight is about 4.75 ounces (135 grams).

In some embodiment, the portable light 10 has a ratio of maximum light output (in lumens) to overall weight (in ounces) of between 70 and 85. In the illustrated embodiment, the ratio is about 76. In some embodiments, the portable light 10 has a ratio of maximum light output (in lumens) to overall volume (in square inches) of between 10 and 30. In the illustrated embodiment, the ratio is about 19.

Although the invention has been described in detail with reference to certain preferred embodiments, variations and modifications exist within the scope and spirit of one or more independent aspects of the invention as described. Various features and advantages of the invention art set forth in the following claims.

What is claimed is:

1. A portable light comprising:

a body having a first end and a second end, the body defining a central longitudinal axis extending through the first end and the second end, the body configured to receive a battery;

a light head pivotably coupled to the first end of the body, the light head pivotable relative to the body about a pivot axis which is offset from the central longitudinal axis between a first position, where the central longitudinal axis intersects the light head, and a second position, where the light head is offset from the central longitudinal axis and the light head is angled at a position greater than 90 degrees relative to the central longitudinal axis;

a first light source supported by the light head, the first light source including a spot light emitting diode configured to emit light in a direction substantially parallel to the central longitudinal axis while the light head is in the first position;

a second light source supported by the light head, the second light source including a flood light emitting diode configured to emit light in the direction substantially parallel to the central longitudinal axis while the light head is in the first position; and an actuator supported by the body, the actuator operable to selectively turn on the first light source and the second light source, wherein the first end of the body includes a first flat surface, and the light head includes a second flat surface, wherein when the light head is in the first position, the first flat surface abuts against the second flat surface.

2. The portable light of claim 1, wherein the light head is pivotable relative to the body about a pivot axis from the first position, where the light head is aligned with the longitudinal axis, to the second position, where the light head is angled 110 degrees relative to the central longitudinal axis.

3. The portable light of claim 2, wherein the light head is pivotable relative to the body to a plurality of intermediate positions between the first position and the second position.

4. The portable light of claim 2, wherein the first and second light sources are configured to emit light in a direction angled relative to the central longitudinal axis.

5. The portable light of claim 1, further comprising a lens coupled to the light head, wherein the lens includes a first section aligned with the first light source, and a second section aligned with the second light source.

6. The portable light of claim 1, further comprising a second actuator supported by the body.

7. The portable light of claim 6, wherein the second actuator is operable to selectively operate the portable light in a first mode where the first light source emits light, and a second mode where the second light source emits light.

8. The portable light of claim 6, wherein the second actuator is operable to selectively operate the second light source to emit light in a high mode, where the second light source emits light at a first intensity, and in a low mode, where the second light source emits light at a second intensity lower than the first intensity.

9. The portable light of claim 1, further comprising a clip coupled to the body and extending parallel to the central longitudinal axis.

10. The portable light of claim 1, wherein the body further includes a charging port configured to be electrically coupled to the battery.

11. The portable light of claim 10, wherein the charging port includes a USB port.

12. The portable light of claim 1, wherein the body includes a battery housing configured to house the battery.

13. The portable light of claim 12, further comprising a cap removably coupled to the second end of the body adjacent the battery housing, wherein the cap includes a magnet configured to magnetically couple to a metallic surface.

14. The portable light of claim 1, wherein the light head includes a heat sink formed of a metallic material, wherein the heat sink defines an outer surface of the light head.

15. A portable light comprising:

a body having a first end and a second end, the body defining a longitudinal axis extending through the first end and the second end, the body configured to receive a battery;

a light head pivotably coupled to the first end of the body, the light head consisting of a heat sink formed of a metallic material, the heat sink formed as a single monolithic part, the heat sink defining an outer surface of the light head and including a plurality of fins formed in the light head;

one or more light emitting diodes coupled to the light head; and a lens coupled to the light head and operable to diffuse light emitted from the one or more light emitting diodes.

16. The portable light of claim 15, wherein the light head is rotatable relative to the body through an angle of 110 degrees.

17. The portable light of claim 15, further comprising an actuator, wherein the actuator is operable to selectively operate the one or more light emitting diodes to emit light in a high mode, where the one or more light emitting diodes emit light at a first intensity, and in a low mode, where the one or more light emitting diodes emit light at a second intensity lower than the first intensity.

18. A portable light comprising:

a body having a first end and a second end, the body defining a longitudinal axis extending through the first end and the second end, the body configured to receive a battery;

a light head pivotably coupled to the first end of the body;

a first light source including a first light emitting diode;

a second light source including a second light emitting diode; and a lens coupled to the light head and including a first section aligned with the first light source and a second section aligned with the second light source, the first section being contoured to diffuse light from the first light source, the second section having a plurality of total internal reflection lenses, wherein the first section and the second section are integrally formed.

19. The portable light of claim 18, wherein the light head is rotatable relative to the body through an angle of 110 degrees.

* * * * *